US008468766B1

(12) United States Patent
Keenan

(10) Patent No.: US 8,468,766 B1
(45) Date of Patent: Jun. 25, 2013

(54) PRECAST CONCRETE FLANGE CONNECTION AND METHOD OF USE

(75) Inventor: Lawrence E. Keenan, Cheshire, CT (US)

(73) Assignee: LEK Innovations, LLC, Hamden, CT (US)

( * ) Notice: Subject to any disclaimer, the term of this patent is extended or adjusted under 35 U.S.C. 154(b) by 0 days.

(21) Appl. No.: 13/397,064

(22) Filed: Feb. 15, 2012

(51) Int. Cl.
*E04B 2/00* (2006.01)

(52) U.S. Cl.
USPC ..... 52/583.1; 52/125.4; 52/699; 52/703; 403/270; 403/292; 403/293; 404/56

(58) Field of Classification Search
USPC ..... 52/583.1, 582.1, 125.4, 699, 236.8, 52/283, 252, 258, 703, 250, 259, 223.7, 396.06, 52/396.04; 403/292–296, 298, 270–272; 404/47, 56–58, 61, 62
See application file for complete search history.

(56) References Cited

U.S. PATENT DOCUMENTS 1,031,926 A * 7/1912 Hansbrough ..... 52/259
3,724,157 A * 4/1973 Miram ..... 52/745.03
3,733,757 A * 5/1973 Scott ..... 52/105
4,835,931 A * 6/1989 Eckerud ..... 52/586.1
6,666,618 B1 * 12/2003 Anaya et al. ..... 404/68
6,679,017 B2 * 1/2004 Woodruff et al. ..... 52/283
2003/0121151 A1 * 7/2003 Reichel et al. ..... 29/897
2003/0131547 A1 * 7/2003 Woodruff et al. ..... 52/283
2012/0192506 A1 * 8/2012 King ..... 52/125.4
2012/0237295 A1 * 9/2012 Kawamoto et al. ..... 404/47

OTHER PUBLICATIONS

Definition of the word "flange" found at: http://www.thefreedictionary.com/flange.*

* cited by examiner

*Primary Examiner* — Brian Glessner
*Assistant Examiner* — Brian D Mattei
(74) *Attorney, Agent, or Firm* — DeLio & Peterson, LLC; Thomas E. Ciesco

(57) ABSTRACT

A metal flange connection for concrete flanges comprising end members exposed at facing ends of a pair of adjacent, generally horizontal concrete flanges and a connecting member between the end members. Each of the end members has a surface along the end of the concrete flange and the connecting member has a first portion extending between the end members in a first generally horizontal plane and a second portion extending between the members in a second generally horizontal plane above or below the first generally horizontal plane. The first and second portions are connected by a third portion extending between the members and the first and second planes. The connecting member portions provide resistance to a force tending to translate the concrete flanges in a vertical direction with respect to each other.

12 Claims, 8 Drawing Sheets

FIG. 14
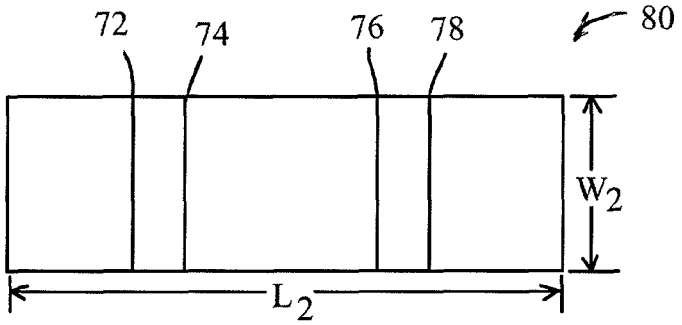
FIG. 15
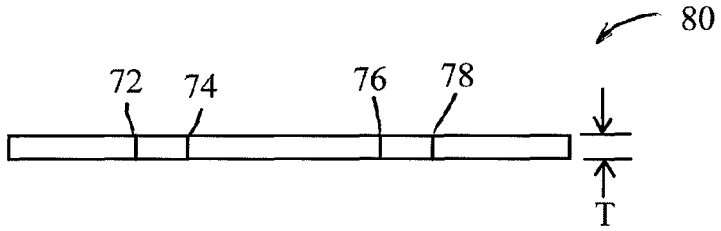
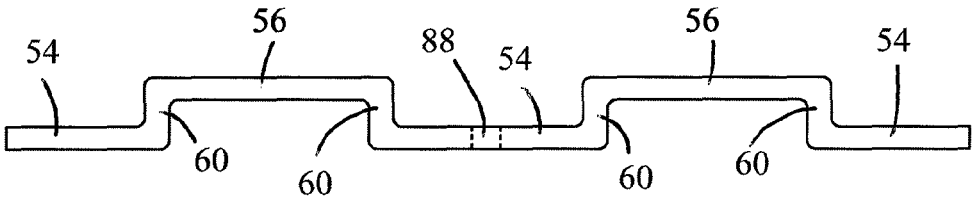
FIG. 16
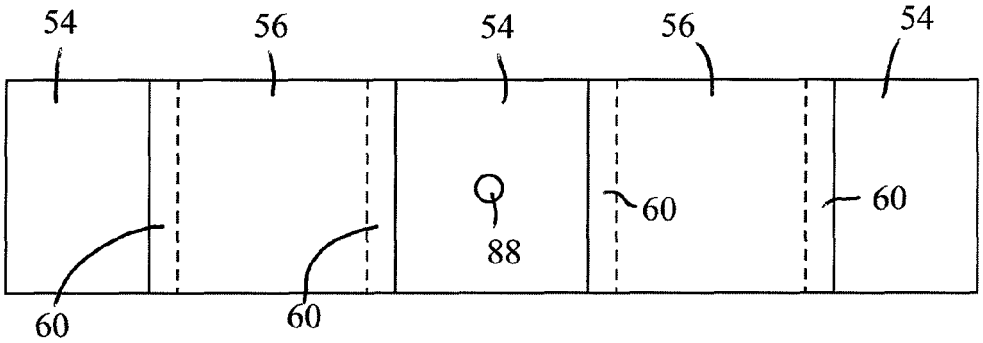
FIG. 17

PRECAST CONCRETE FLANGE CONNECTION AND METHOD OF USE

BACKGROUND OF THE INVENTION

1. Field of the Invention

The present invention relates to the creation, replacement, restoration and reinforcement of concrete structure connections.

2. Description of Related Art

Precast, prestressed concrete parking garages have become one of the most popular methods for parking garage construction. This construction consists of fabrication of discrete precast concrete elements or members that are transported to the construction site, lifted into position and connected together.

As shown in the prior art drawings of FIGS. 1 and 2, precast concrete structures typically consist of "tee" or "double tee" beams 26, girders 34, columns 32 and lateral bracing members 30. A lateral bracing member 30 may be a shear wall, brace or frame. The tee/double tee beams are connected together to form the floor/deck. The deck supports gravity loads from vehicles and may be formed from one or more diaphragms. Diaphragms are, in effect, large horizontal beams that transmit lateral loads from seismic and wind events to points of lateral support, typically lateral bracing members 30. The diaphragm may be composed of one or more rows of precast concrete members 26. To form the deck the tee beams are connected to one another with two types of connections, shear connections and chord connections. Tension, compression, vertical shear and horizontal shear are each addressed with connections to resist the respective force or load. Shear connections 56 provide mutual support to gravity (wheel) loads while also transmitting shear within the plane of the deck. Chord connections 58 provide mutual support to gravity (wheel) loads and form chords that restrain tension and compression forces due to in-plane bending of the diaphragm in the manner similar to that in which reinforcement steel restrains tension in a concrete beam under bending. FIG. 2 shows chords 45 extending from one end of the diaphragm to the opposite end.

An example of the precast member 26 is a double tee beam shown in FIG. 3 and includes a platform having a length L and a width W. The platform consists of a horizontal center panel 40 and flanges 24 extending outward from the center panel. The double tee beam 26' includes a pair of beam webs 12 extending normal to and below the platform, the beam web having beam web ends 44 and beam web sides 46 extending between the beam web ends 44. The flange 24 includes flange ends 38 substantially parallel to the beam web 12.

Chord connections 58 are typically used in precast concrete structures and are shown in FIGS. 4A-4C and FIG. 5 while shear connections 56 may encompass the connections shown in FIGS. 4A-5 and provide stability from shear forces. Both shear connections and chord connections are typically achieved by placing a loose erection plate 22', flat plate 76 or erection bar 22 between adjacent flanges 24 and welding them to steel plates 20, 20' embedded within the precast members. Embedded steel plates 20, 20' are installed during fabrication of the concrete member prior to placement of the concrete in the formwork. Anchorage of the plate within the concrete is typically achieved by welding the plate to a steel bar, stud or rebar 28 prior to fabrication. Weld joints 19 are made at the upper contact points of the embedded plates 20 and the bar 22 or plate 22'. Weld 76 is located at the upper contact point of the embedded plate 20 and the flat plate 76. The steel plates are positioned within the end of the flange 24 such that the face of each plate is exposed on the end of the flange. Once the tee beam is placed into position during fabrication of the concrete structure, the gap between embedded plates 20 are bridged with a dowel 22, loose erection bar 22' or flat plate 76 and welded together. Once welded, this creates a continuous steel chord or shear connection 56 within the edge of the diaphragm/deck. The chord connections 58 have an upper cavity 90 which may be filled with a sealant and/or grout. Alternatively or in combination, a layer of concrete may be spread across the top of the flange 24 and flange connection. The shear connections 56 may also have an upper cavity 90 which may be filled with a sealant and/or grout. The chord connections 58 form chords 45 which are embedded in the platform of the diaphragm. The steel bar 28, the steel plate 20 and the erection bar 22', flat plate 76 or plate 22 make up the chord 45 and typically extends through all of the platforms in the diaphragm.

The shear connection shown in the top plan view of FIG. 4D is a proprietary Vector Connector 41 consisting of a bent plate 25*b* with wings 25*a* embedded in the flange 24, and although it is not attached to rebar, the wings 25*a* provide sufficient anchorage to act as a shear connection. The bent plate 25*b* is welded to the bent plate of the adjacent Vector Connector 41 using an erection plate 22'. The Vector Connector is not sufficient for tension forces and usually supplements the welded chord connections. The Vector Connections are usually spaced between the chord connections 58 which are along or near the outer edges of the diaphragm.

One primary weakness of the systems shown in FIGS. 4A-4D is that the connection has insufficient geometry to resist the concrete members moving in a vertical direction in relation to each other causing the connector 22 to rotate about the weld joint or welded connection 19 since each welded connection 19 acts as a pivot.

FIGS. 5 and 6 show an embodiment of a prior art connector which includes a flat bar 76 welded to the embedded steel plates 20. This embodiment also has insufficient geometry to resist the concrete members moving in a vertical direction in relation to each other causing the connector 76 to rotate about the weld joint 47 or welded joint 49 since each welded joint 47,49 acts as a pivot. The flat bar 76 may rotate about each of the weld joints 47,49 when forces on the flanges 24 cause the flanges to move in a vertical direction in relation to one another. The movement of the flanges in this direction is also called translation.

The existing methods of construction produce numerous problems and failures, generally due to poor design, poor fabrication in the shop, poor construction in the field, and in service deterioration. Weld code provisions do not intend or allow welds to be used in the manner in which they are loaded in this connection.

SUMMARY OF THE INVENTION

Bearing in mind the problems and deficiencies of the prior art, it is therefore an object of the present invention to provide a system for creating, replacing, restoring or reinforcing connections along adjacent flanges of precast concrete members.

It is another object of the present invention to provide a system for connecting concrete flanges which provides a resistance to rotational, tension and compression forces.

Still other objects and advantages of the invention will in part be obvious and will in part be apparent from the specification.

The above and other objects, which will be apparent to those skilled in the art, are achieved in the present invention which is directed to a flange connection for a concrete structure comprising a flange having a flange edge and an embedded metal plate secured along the flange edge and a flange connector. The flange connector includes a flat horizontal upper member securable to the embedded plate, a flat horizontal lower member securable to the embedded plate disposed in a horizontal position lower than the upper member and a vertical member integral with the upper and lower member. The embedded metal plate may be a portion of a vector connection. The flange connector may be weldable to the embedded metal plate. The vertical distance between the flat horizontal upper member and the horizontal lower member is sufficient to prevent rotational movement or twisting of the connector. The flange connection may include a second flat horizontal lower member and a second vertical member integral with the second horizontal lower member. The flange connection may include a plurality of flat horizontal lower members, a plurality of flat horizontal upper members and a plurality of vertical members integral with at least one of the horizontal lower members and at least one of the horizontal upper members.

Another aspect of the present invention is directed to a method for using a flange connection. The method comprises providing a flange having a flange edge and an embedded plate secured along the flange edge and a flange connector. The flange connector includes a flat horizontal upper member securable to the embedded plate, a flat horizontal lower member securable to the embedded plate a distance lower than the upper member and a vertical member integral with the upper and lower member. The method includes securing the upper and lower member to the embedded plate.

Another aspect of the present invention is directed to a metal flange connection for concrete flanges comprising end members exposed at facing ends of a pair of adjacent, generally horizontal concrete flanges and a connecting member between the end members. Each of the end members has a surface along the end of the concrete flange, the connecting member having a first portion extending between the end members in a first generally horizontal plane and a second portion extending between the members in a second generally horizontal plane above or below the first generally horizontal plane. The first and second portions are connected by a third portion extending between the members and the first and second planes, providing resistance to a force tending to translate the concrete flanges in a vertical direction with respect to each other.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

FIG. 14 is a top elevational view of a metal strip and bend lines locations for forming the metal strip into the flange connector.

FIG. 15 is a front elevational view of a metal strip and bend lines locations for forming the metal strip into the flange connector.

FIG. 16 is a front elevational view of a second embodiment of the flange connector according to the present invention.

FIG. 17 is a top elevational view of a second embodiment of the flange connector according to the present invention.

DESCRIPTION OF THE PREFERRED EMBODIMENTS

In describing the preferred embodiment of the present invention, reference will be made herein to FIGS. 7-23 of the drawings in which like numerals refer to like features of the invention.

The present invention is an apparatus and a system for creating, replacing, restoring or reinforcing flange connections of adjacent precast concrete structures. The system includes providing flange connections along the flanges of adjacent concrete structures. The flange connection may secure the tee beams from tension and compression forces and from forces which rotate or twist one beam from the adjacent beam.

Figure 1:
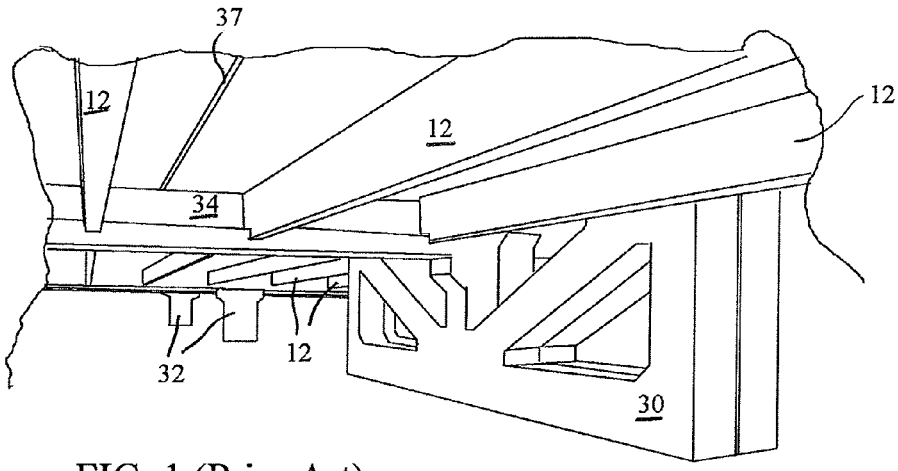
FIG. 1 (Prior Art)
FIG. 1 is a prior art perspective view of a concrete structure.
Figure 2:
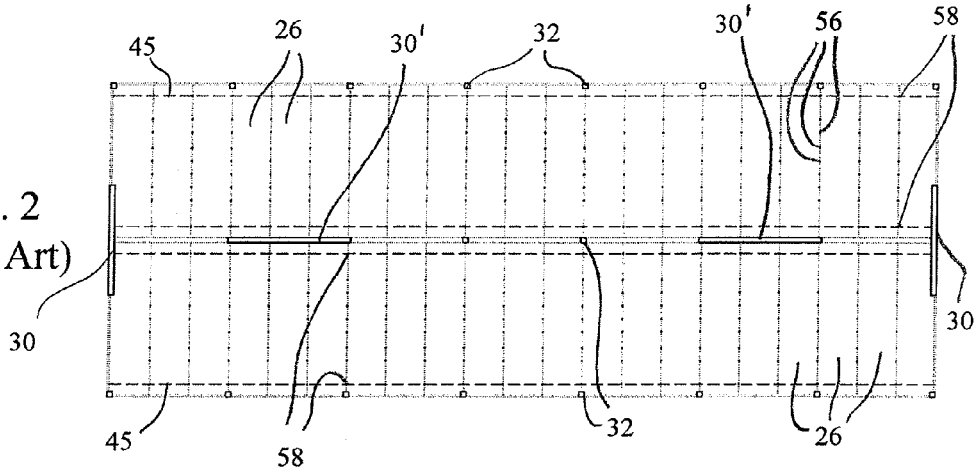
FIG. 2 (Prior Art)
FIG. 2 is a top elevational view of a concrete structure having chord and shear connections.
Figure 3:
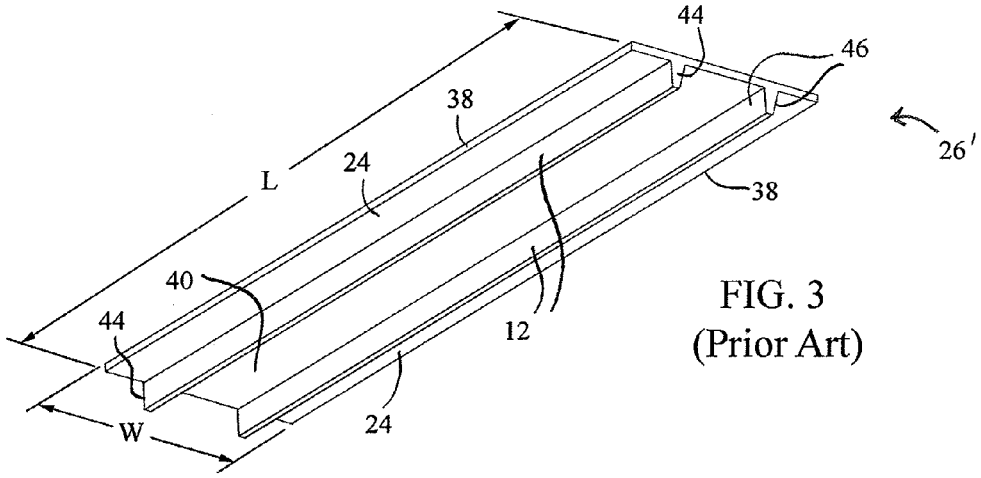
FIG. 3 (Prior Art)
FIG. 3 is a perspective view of a double tee beam.
Figure 4A:
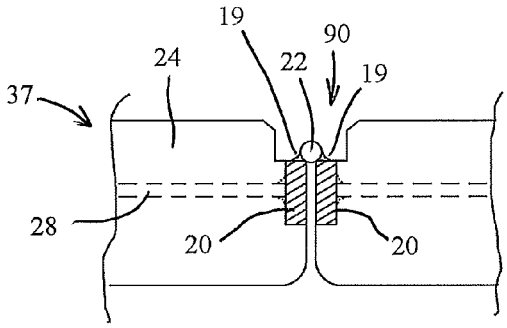
FIG. 4A (Prior Art)
FIG. 4A is a cross sectional end view of a prior art flange connection.
Figure 4B:
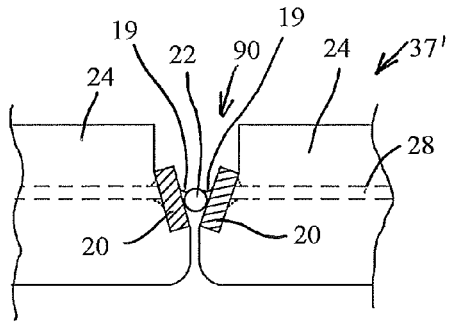
FIG. 4B (Prior Art)
FIG. 4B is a cross sectional end view of a second embodiment of a prior art flange connection.
Figure 4C:
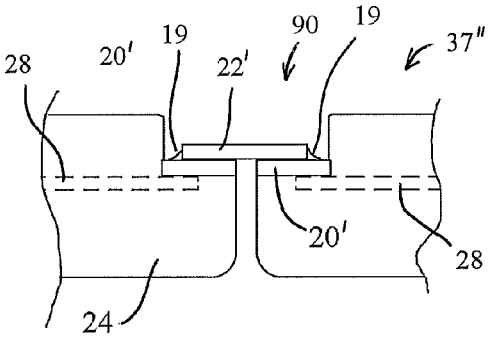
FIG. 4C (Prior Art)
FIG. 4C is a cross sectional end view of a third embodiment of a prior art flange connection.
Figure 4D:
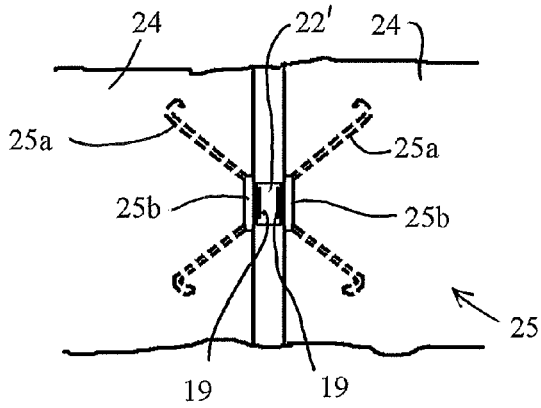
FIG. 4D (Prior Art)
FIG. 4D is a top plan view of a vector connection in a prior art flange connection.
Figure 5:
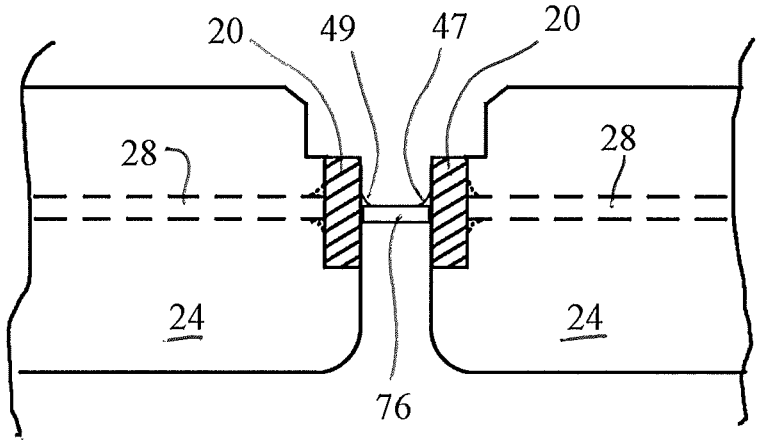
FIG.5 (Prior Art)
FIG. 5 is a cross sectional end view of a fourth embodiment of a prior art flange connection.
Figure 6:
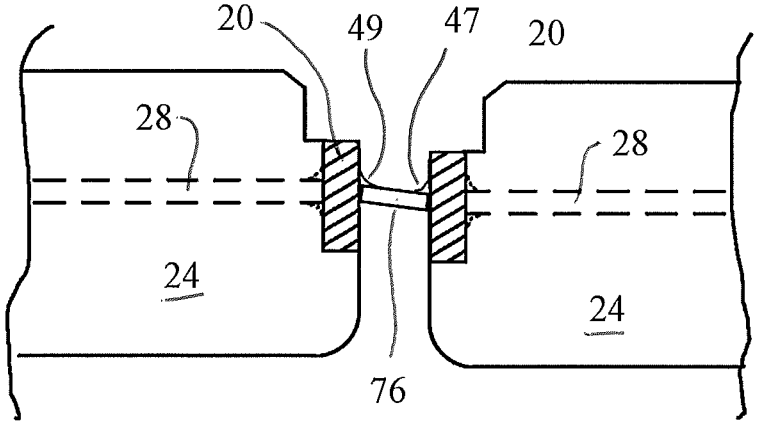
FIG. 6 (Prior Art)
FIG. 6 is a cross sectional end view of the prior art flange connection shown in FIG. 5 with the flanges translated vertically from one another.
Figure 7:
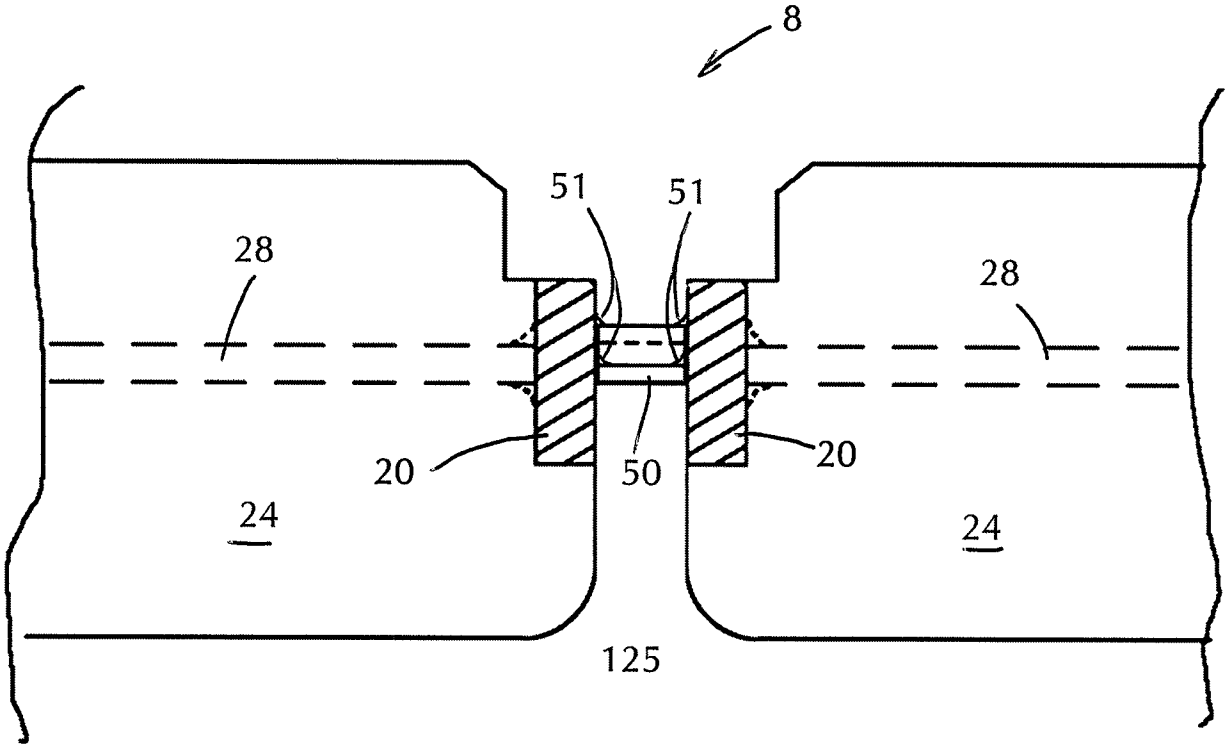
FIG. 7 is a side elevational view of a flange connection system according to the present invention.
Figure 8:
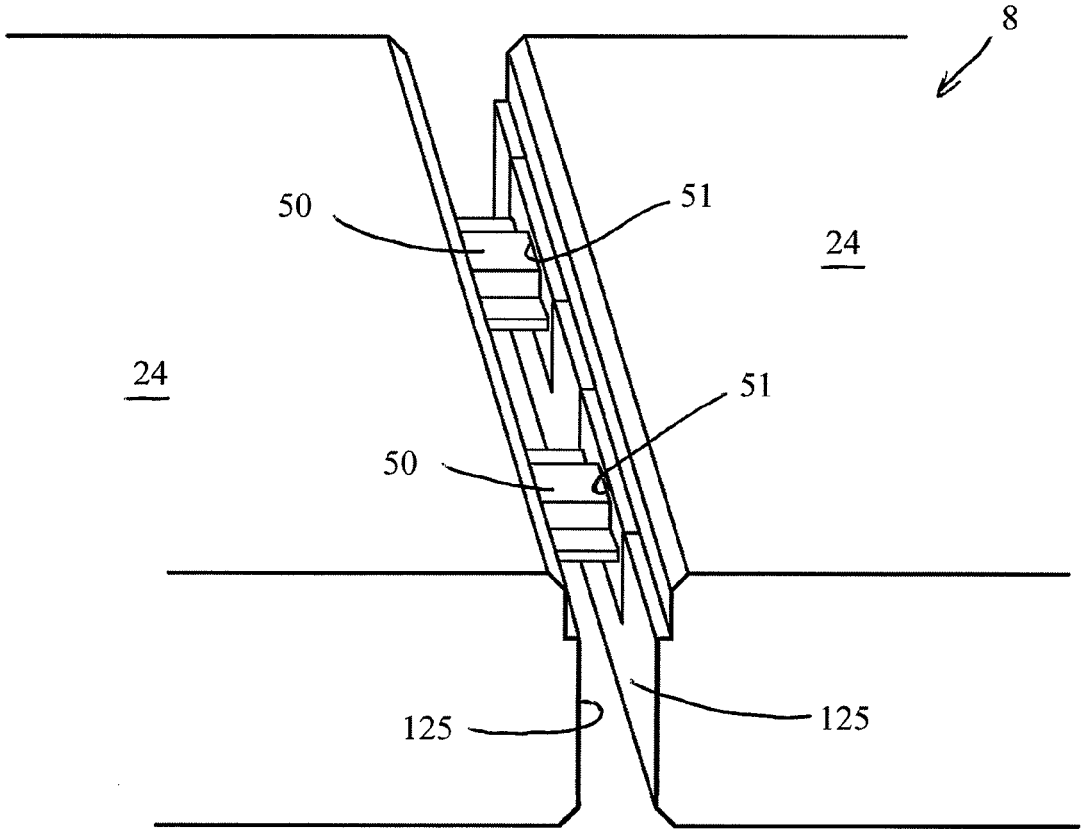
FIG. 8 is a perspective view of the flange connection system according to the present invention.
Figure 9:
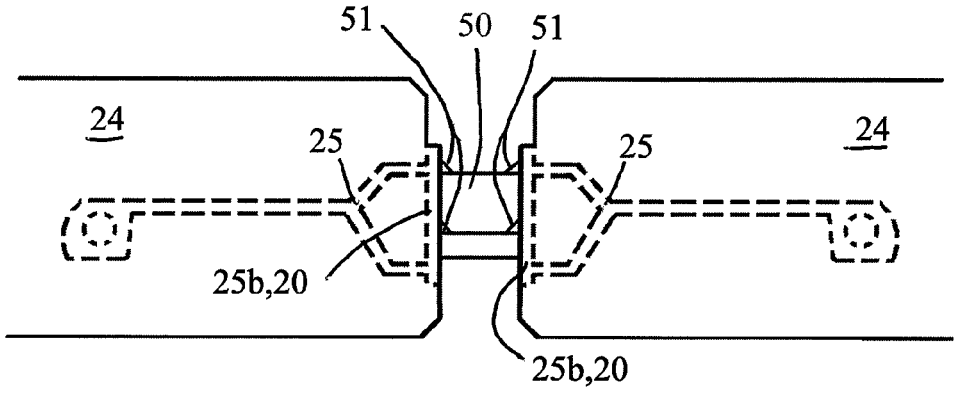
FIG. 9 is a front elevational view of the flange connection system according to the present invention.
Figure 10:
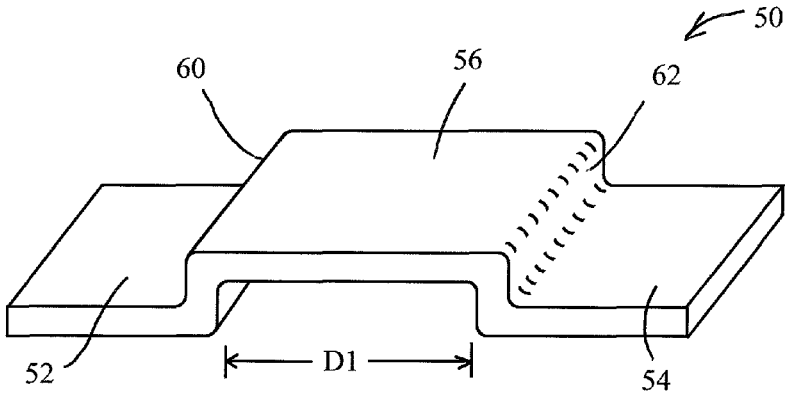
FIG. 10 is a perspective view of the flange connector according to the present invention.
Figure 11:
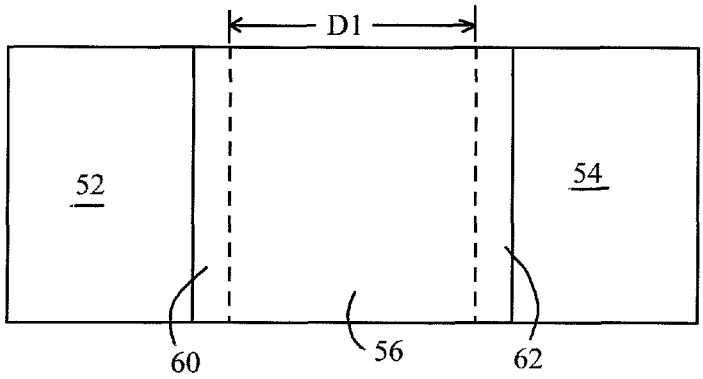
FIG. 11 is a top elevational view of the flange connector shown in FIG. 8.
Figure 12:
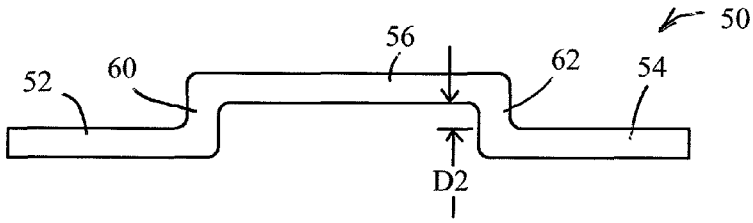
FIG. 12 is a front elevational view of the flange connector shown in FIG. 8.
Figure 13:
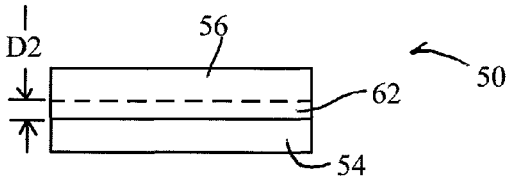
FIG. 13 is a side elevational view of the flange connector shown in FIG. 8.
Figure 18:
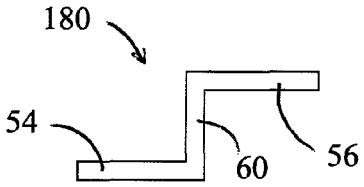
FIG. 18 is a front elevational view of an alternate embodiment of the flange connector shown in FIG. 10.
Figure 19:
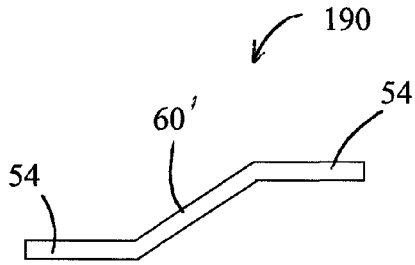
FIG. 19 is a front elevational view of a second alternate embodiment of the flange connector shown in FIG. 10.
Figure 20:
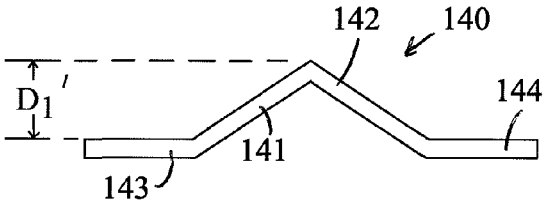
FIG. 20 is a front elevational view of a third alternate embodiment of the flange connector shown in FIG. 10.
Figure 21:
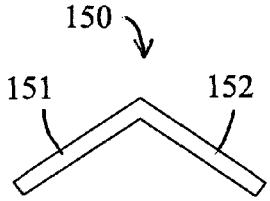
FIG. 21 is a front elevational view of a fourth alternate embodiment of the flange connector shown in FIG. 10.
Figure 22:
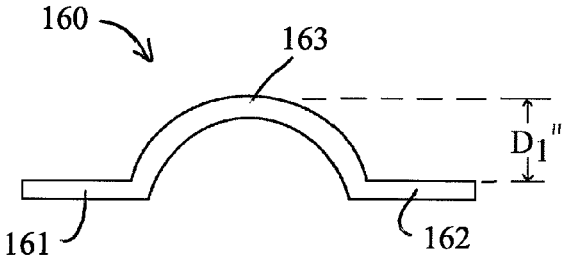
FIG. 22 is a front elevational view of a fifth alternate embodiment of the flange connector shown in FIG. 10.
Figure 23:
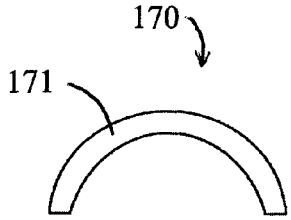
FIG. 23 is a front elevational view of a sixth alternate embodiment of the flange connector shown in FIG. 10.

FIGS. 7 and 8 shows a flange connection system 8 which includes a pair of adjacent flanges 24, each flange 24 having a flange end 125. The flange connection system 8 includes an embedded steel plate 20 secured along the flange end 125 and a connector 50 secured between adjacent plates 20 by weld joints 51. The embedded plate 20 may be secured along the flange end 125 by steel bar 28 or the embedded plate may be a face portion 25*b* of a vector connector as shown in FIG. 9.

As shown in FIGS. 10-13, the connector 50 comprises a pair of co-planar plates 52,54, each separated a distance D1 from one another and an upper metal plate 56 parallel to and a distance D2 from the plane of the first pair. The upper plate 56 is horizontally located between the co-planar plates 52,54 and vertically located above the plates 52,54. Vertical plates 60,62 are connected to and extend between the upper plate and the pair of co-planar plates. The distance D2 is proportional to the deflection force which may be applied to the platforms before the connector fails. As the distance D2 is increased, the ability for the flange connector to resist rotational and twisting forces between flanges increases.

The vertical plates may be perpendicular to the upper and lower plates, giving the connector a high resistance to twisting. The vertical plate may also be at an angle other than 90 degrees, giving the worker easier access to the weld points when welding the connector to the metal plate embedded in the flange of the platform.

In another aspect, the metal flange connection for concrete flanges comprises end members of a concrete platform exposed at facing ends of a pair of adjacent, generally horizontal concrete flanges and a connecting member between the end members. Each of the end members has a surface along the end of the concrete flange. The connecting member has a first portion extending between the end members in a first generally horizontal plane and a second portion extending between the members in a second generally horizontal plane above or below the first generally horizontal plane. The first and second portions are connected by a third portion extending between the members and the first and second planes.

As shown in FIGS. 14 and 15, the connector 50 may be formed from a flat metal strip 80 having a length $L_2$, a width $W_2$ and a thickness T. The flat metal strip may be bent transversally across the strip width $W_2$ along transition lines 72,74, 76,78.

In an alternate embodiment, the connector 50 may be formed by welding each of the horizontal plates 52,54,56 to the adjacent vertical plate 60,62.

FIGS. 16 and 17 show an alternate embodiment of the connector which includes a plurality of upper plates 56 and a plurality of lower plates 54 parallel to the upper plates 56 and separated a vertical distance from the upper metal plate. The vertical plate 60 extends between the lower plate 54 and an adjacent upper plate 56. Each plate is welded to the embedded steel plate 20. At least one of the lower plates may include an opening 88 to allow for liquid drainage so that a liquid will not accumulate on the lower plate 54.

In a method for installing the connector, the steps include providing a connector according to claim 1 for insertion between two adjacent flanges, ensuring the connector width is sufficient to allow positioning between the metal plates of adjacent flanges, welding the connector to one of the metal plates, welding the connector to the other metal plate, allowing the welds to cool and filling the space above the connector with a caulk or epoxy.

In another method for installing the connector, the steps include providing a first and second flange having flange ends and a metal plate embedded along the flange end. The steps include providing a connector according to claim 1, ensuring the connector width is sufficient to allow positioning between the metal plates of adjacent flanges, welding the connector to one of the metal plates, welding the connector to the other metal plate, allowing the welds to cool and filling the space above the connector with a caulk or epoxy.

FIGS. 18-23 show cross sectional views or alternate embodiments of the connector 50. Connector 180 includes a flat horizontal upper member 56, a flat horizontal lower member 54 disposed in a position lower than the upper member 56 and a vertical member 60 integral with the upper and lower member. Connector 190 includes a flat horizontal upper member 56, a flat horizontal lower member 54 disposed in a position lower than the upper member 56 and an angled member 60' integral with the upper and lower members 56, 54. Connector 140 includes horizontal plates 143 and 144 and angled plates 141 and 142. Connector 150 includes horizontal plates 161 and 162 and a curved plate 163. The height D1' and D1" are measured from the peak of the connector to the upper surface of the horizontal plates 143, 144, 161 and 162. Connector 160 includes only angled plates 151 and 152. Connector 170 includes only a curved plate 171.

The present invention has been shown to achieve the object of the invention including providing a system for creating, replacing, restoring or reinforcing connections along adjacent flanges of tee/double tee beams. The system also provides a system for efficient low cost creation, replacement, restoration or reinforcement of flange connections in a concrete structure.

The present invention achieves the objectives of providing a system for creating, replacing, restoring or reinforcing connections along adjacent flanges precast concrete members as well as providing a system for creation, replacement, restoration or reinforcement of a shear connection in a concrete structure. The objective to provide a system for efficient low cost creation, replacement, restoration or reinforcement of flange connections in a concrete structure has been met.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. A flange connection for adjacent concrete structures comprising:

a first concrete structure flange having a first flange edge and a first embedded metal plate secured along the first flange edge;

a second concrete structure flange having a second flange edge and a second embedded metal plate secured along the second flange edge;

a flange connector including;

a flat horizontal upper member extending from the first embedded metal plate to the second embedded metal plate, securable to the first and second embedded plates;

a flat horizontal lower member extending from the first embedded metal plate to the second embedded plate, securable to the first and second embedded plates and disposed in a horizontal position lower than the upper member; and a vertical member integral with the upper and lower member.

2. The flange connection of claim 1 wherein the first and second embedded plates are a portion of a vector connector.

3. The flange connection of claim 1 wherein the flange connector is weldable to the first and second embedded metal plates.

4. The flange connection of claim 1 wherein the vertical distance between the flat horizontal upper member and the horizontal lower member prevents rotational movement or twisting of the connector.

5. The flange connection of claim 1 including a second flat horizontal lower member and a second vertical member integral with the second horizontal lower member.

6. The flange connection of claim 1 including a plurality of flat horizontal lower members, a plurality of flat horizontal upper members and a plurality of vertical members integral with at least one of the horizontal lower members and at least one of the horizontal upper members, the plurality of flat horizontal lower and upper members extending from the first embedded metal plate to the second embedded metal plate.

7. A method for using a flange connector comprising:

providing a first concrete structure flange having a first flange edge and a first embedded plate secured along the first flange edge;

providing a second concrete structure flange having a second flange edge and a second embedded plate secured along the second flange edge;

providing a flange connector including;

a flat horizontal upper member extending from the first embedded metal plate to the second embedded metal plate, securable to the first and second embedded plates;

a flat horizontal lower member extending from the first embedded metal plate to the second embedded plate, securable to the first and second embedded plates and disposed in a horizontal position lower than the upper member; and a vertical member integral with the upper and lower member;

securing the upper and lower member to the first and second embedded plate.

8. The method of claim 7 wherein the first and second embedded plates are a portion of a vector connector.

9. The method of claim 7 wherein the flange connector is weldable to the first and second embedded plates.

10. The method of claim 7 wherein the vertical distance between the flat horizontal upper member and the horizontal lower member prevents rotational movement or twisting of the connector.

11. The method of claim 7 including a second flat horizontal lower member and a second vertical member integral with the second horizontal lower member.

12. The method of claim 7 including a plurality of flat horizontal lower members, a plurality of flat horizontal upper members and a plurality of vertical members integral with at least one of the horizontal lower members and at least one of the horizontal upper members, the plurality of flat horizontal lower and upper members extending from the first embedded metal plate to the second embedded metal plate.

* * * * *